United States Patent [19]

Ishimatsu et al.

[11] 4,105,192

[45] Aug. 8, 1978

[54] PROCESS AND APPARATUS FOR PRODUCING ZIRCONIUM SPONGE

[75] Inventors: Kazuhiko Ishimatsu, Higashi-Kurume; Takao Nakahara, Wako; Akira Murata, Tokyo; Masami Kuroki, Urawa, all of Japan

[73] Assignee: Nippon Mining Company, Tokyo, Japan

[21] Appl. No.: 679,624

[22] Filed: Apr. 23, 1976

Related U.S. Application Data

[62] Division of Ser. No. 631,293, Nov. 12, 1975.

[30] Foreign Application Priority Data

Feb. 13, 1975 [JP] Japan ..... 50-17474

[51] Int. Cl.[2] ..... C22B 61/02

[52] U.S. Cl. ..... 266/149; 75/84.5; 266/905

[58] Field of Search ..... 266/149, 171, 905; 75/84.4, 84.5

[56] References Cited

U.S. PATENT DOCUMENTS

| | | | |
|---|---|---|---|
| 2,663,634 | 12/1953 | Stoddard et al. | 75/84.5 |
| 2,825,642 | 3/1958 | Eaton et al. | 75/84.5 |
| 2,944,887 | 7/1960 | Gray | 266/905 X |
| 3,069,255 | 12/1962 | Baker, Jr. et al. | 75/84.5 |
| 3,113,017 | 12/1963 | Homme | 266/905 X |
| 3,684,264 | 8/1972 | Petrov et al. | 266/905 X |
| 3,966,460 | 6/1976 | Spink | 75/84.4 |

*Primary Examiner*—Roy Lake
*Assistant Examiner*—Paul A. Bell
*Attorney, Agent, or Firm*—Sughrue, Rothwell, Mion, Zinn and Macpeak

[57] ABSTRACT

Apparatus and method for producing zirconium by reducing zirconium halides in the presence of a reducing agent and an inert gas. The zirconium halide is mostly reduced while being in the solid state. The apparatus permits successive reduction and vaccum distillation in one batch.

5 Claims, 5 Drawing Figures

FIG. 2
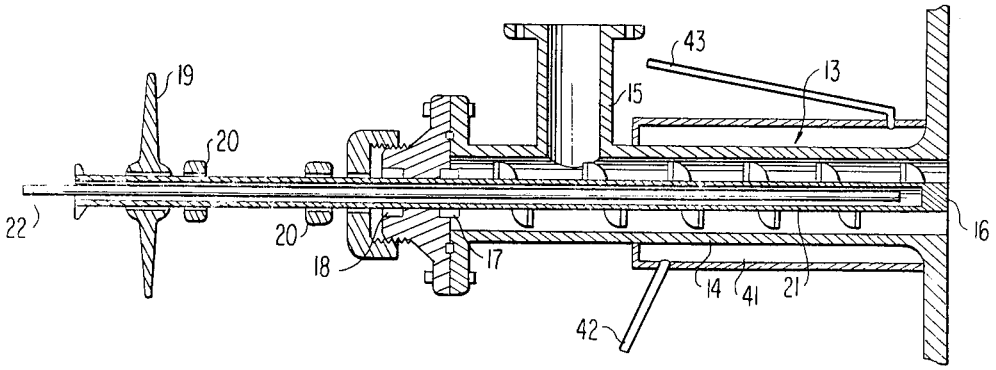
FIG. 3
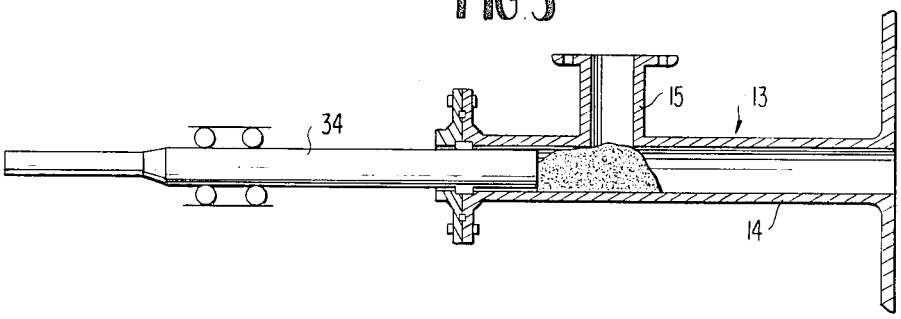
FIG. 4
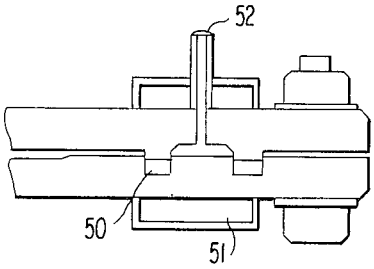
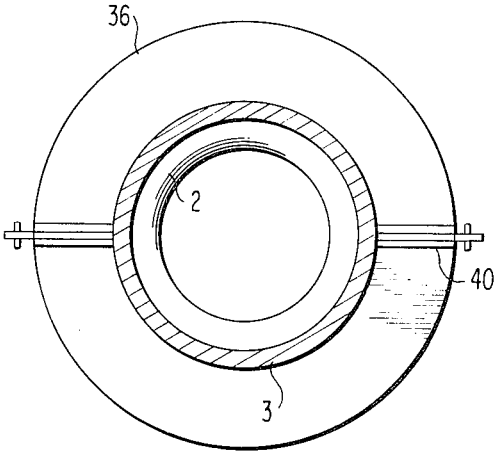
FIG. 5

PROCESS AND APPARATUS FOR PRODUCING ZIRCONIUM SPONGE

This is a Division of application Ser. No. 631,293, filed Nov. 12, 1975.

BACKGROUND OF THE INVENTION

Field of the Invention

This invention relates to a process and an apparatus for producing zirconium sponges by reducing zirconium halide with a reducing agent such as magnesium, sodium, and the like.

Processes and apparatus for commercially producing zirconium sponge have already been proposed wherein purified dense or powder zirconium tetrachloride and magnesium (or sodium) are placed at one time into a reaction chamber and heated at an elevated temperature in the presence of an inert gas such as argon to be vaporized and then reduced with the magnesium (or sodium). The inert gas is introduced in the reaction chamber in such a way that the internal pressure of the reaction chamber is held slightly higher than the atomospheric pressure for the purposes of preventing the reduction from rapidly proceeding to raise the temperature and preventing even trace amount of nitrogen and oxigen from having an undesirable effect on the produced zirconium sponge. However, such prior processes and apparatus have had numerous disadvantages as follows:

(1) The reaction chamber itself is required to have a considerably wide space for receiving the purified dense or powder zirconium tetrachloride which is previously placed therein, and the volume of the produced zirconium sponge is less than approximately one-eighth of that of the reaction chamber since only one reaction is possible in every batch.

(2) The zirconium tetrachloride is reacted in the gas state with the magnesium, and therefore a great amount of heating energy is required to vaporize the zirconium tetrachloride at an elevated temperature.

(3) The internal pressure of the reaction chamber, which increases as temperatures get higher, is ordinally adjusted by discharging the inert gas from the reaction chamber so as to maintain the pressure slightly higher than atomospheric pressure. At this time, some zirconium tetrachloride gas is discharged along with the inert gas so as to be wasted and so as to condense and adhere to portions such as a valve whose temperature is relatively low (below 331° C), resulting in blockade of pipes or the like.

(4) It is very difficult and requires special training or skill to properly control the discharge of the inert gas since the inert gas is randomly mixed with the zirconium tetrachloride gas. Therefore, the inert gas is sometimes discharged above the proper amount and the zirconium tetrachloride gas is excessively concentrated within the reaction chamber so that the reduction proceeds more rapidly than is normally the case and a great amount of formation heat applies to the reaction chamber. Although the reaction chamber is made of a heat-resisting metal, when the reaction chamber is heated above 935° C, eutectic taking place between Fe and Zr to form a Fe — Zr alloy has a direct effect upon the reaction chamber, thereby deteriorating the quality of the produced zirconium sponge. Conversely, the inert gas is sometimes discharged below the proper amount so that the reduction proceeds slowly and requires extremely long reduction times, which is disadvantageous in economy.

Further, in the prior processes and apparatus, the zirconium tetrachloride is vaporized and the reduction is carried out by reacting zirconium tetrachloride gas on the magnesium and not directly on the solid zirconium tetrachloride. No commercial attenmpt has been proposed in the art wherein solid zirconium tetrachloride is directly reacted with magnesium for the reason that it is difficult to produce powder zirconium tetrachloride free from impurities, such as oxygen, which have an undesirable effect upon the quality of the produced zirconium sponge. Also, no commercial attempt has been proposed in the art wherein solid zirconium tetrachloride is directly supplied in a reaction amount to a reaction chamber which has been heated to an elevated temperature. The reason for this is that zirconium tetrachloride sublimes at 331° C and if the chamber is at an elevated temperature when the zirconium tetrachloride is supplied thereto, the zirconium tetrachloride gas would flow from the reaction chamber into the supply means, condensing and adhering on certain portions thereof, resulting in blockade of the supply means.

This invention further relates to an apparatus for producing metallic zirconium by vacuum separation processes without cooling the product obtained from the reduction of the halogenated zirconium with magnesium or sodium.

In the hitherto used apparatus for producing metallic zirconium, a condenser means for vacuum separation of the reduced product is independent of the reaction chamber wherein the zirconium halide is reduced. Therefore the vacuum distillation process cannot be carried out before the product is cooled and conveyed from the reaction chamber into the condenser means. Accordingly, many disadvantages have been found in such prior apparatus such as:

(1) A great amount of heating energy is required for a relatively long time to reheat the once cooled product up to an elevated temperature.

(2) The reduced by-products which is the zirconium sub chlorides and the magnesium chloride is exposed to the air resulting in absorbing moisture, thereby deteriorating the quality of the zirconium sponge.

(3) In conveying the reduced product from the reaction chamber to the condenser means for vacuum separation, the zirconium sub chlorides decomposes to exhaust a harmful gas in the air. Further, the moisture absorption of the magnesium chloride cause the generation of hydrogen chloride in the initial degassing stage, which results in breakage of the vacuum pump.

SUMMARY OF THE INVENTION

Accordingly, it is an object of this invention to provide a novel process and apparatus for producing zirconium sponge in which solid zirconium halide is directly reduced with a reducing agent by a certain amount.

Another object of this invention is to provide a novel process and apparatus for producing zirconium sponge which will be effective and economical to produce the zirconium sponge.

Still another object of this invention is to provide a novel process and apparatus which will be free from the abovementioned and other disadvantages of the prior art processes and apparatus.

A feature of this invention is a process for producing zirconium sponge wherein solid zirconium halide is directly contacted with and reduced with a reducing agent such as magnesium, sodium, or the like by a predetermined amount. Several reduction processes can be repeated by a batch so as to produce the zirconium sponge as much as possible within a reaction chamber.

Another feature of this invention is an apparatus for producing zirconium sponge, comprising a reaction chamber for receiving a reducing agent such as alkaline earth metal or alkali metal, supplying means for supplying zirconium halide in the solid state into the reaction chamber, a first pipe for charging the reducing agent and discharging fused metal salt from the reaction chamber, and a second pipe extending within the reaction chamber for charging and discharging an inert gas to adjust the internal pressure of the reaction chamber.

Still another object of this invention is an apparatus in which the reduction of the zirconium halide and the vacuum separation of the reduced product can be carried out in a single unit.

BRIEF DESCRIPTION OF THE DRAWINGS

An even more complete understanding of this invention may be gained from the following detailed description when read in conjunction with the appended drawings, wherein:

FIG. 2 is an expanded sectional view of supply means shown in FIG. 1;

FIG. 3 is a sectional view showing another embodiment of the supply means;

FIG. 4 is an expanded view of a fixing flange; and

FIG. 5 is a top plan view of a receiver for cooling water.

DESCRIPTION OF THE PREFERRED EMBODIMENT

Figure 1:
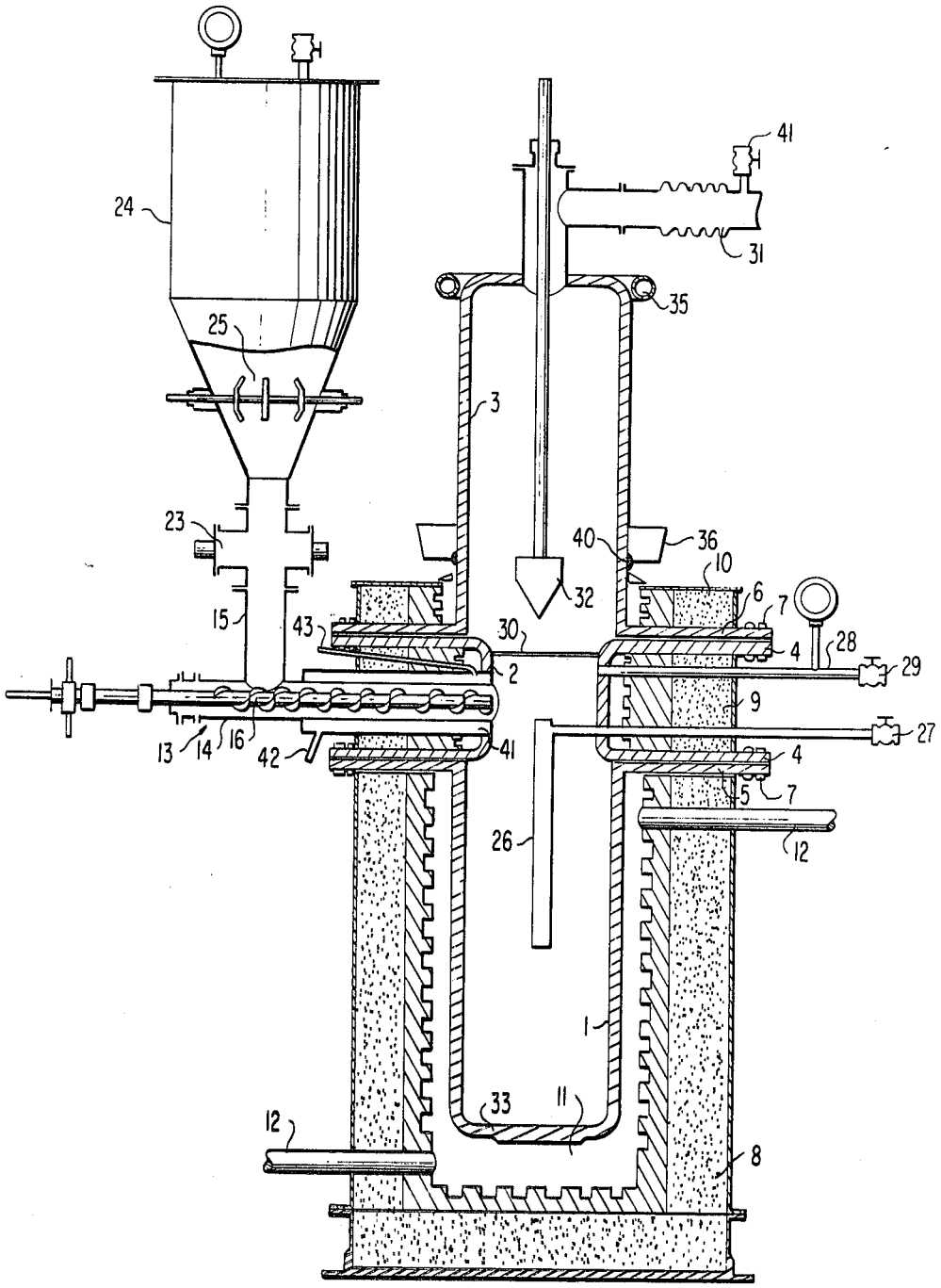
FIG. 1 is a sectional view showing a zirconium sponge producing apparatus according to this invention.

Referring now to the drawings, and to FIGS. 1 and 2 in particular, there is illustrated an apparatus for producing zirconium sponge by reducing solid zirconium tetrachloride with magnesium or sodium and for separating metallic zirconium from the reduced product by vacuum distillation. The apparatus comprises a reaction chamber 1 made of, for example, heat-resisting steel which is contained within an electric heating furnace 8 in spaced relation thereto. Formed between the reaction chamber 1 and the furnace 8 is a space 11 in communication via pipe 12 with another means, not shown, for introducing a cooling gas into the space 11 so as to cool the reaction chamber 1 during the reduction of the solid zirconium tetrachloride and for making the space 11 vacuous so as to prevent the reaction chamber 1 from deforming during the vacuum distillation of the metallic zirconium. The reaction chamber 1 is provided at its bottom portion with a bottom plate 33 made of, for example, heat-resisting steel which may be pierced for removal of the produced zirconium sponge. Also, the reaction chamber 1 has its upper end opened and provided with a flange 5 resting on the furnace 8.

A longitudinally cylindrical compartment rest 2 is contained within an electric heating furnace 9 and provided at its lower end with a flange 4 bolted to the flange 5 through packing means, such as for example, a metal packing or a silicon rubber packing for connecting the compartment rest 2 in series with the reaction chamber 1 in such a way that the compartment rest 2 slightly projects inwardly from the inner surface of the reaction chamber 1.

Extending through the compartment rest 2 is a pipe 26 which is downwardly curved so that one end thereof is located in the substantially intermediate position of the reaction chamber 1 and the other end is connected through a valve 27 to another means, not shown, for introducing magnesium into the reaction chamber 1 and discharging magnesium chloride therefrom. Also, a pipe 28 extends through the compartment rest 2, the one end of which is opened to the inner face of the compartment rest 2 and the other end of which is connected through a valve 29 to another means, not shown, for charging and discharging an inert gas such as argon gas to and from the reaction chamber 1 so that the internal pressure of the reaction chamber 1 can be adjusted at a substantially constant value. The reaction chamber 1 is sealed by a plate 30 secured to the inner face of the compartment rest 2 above the pipes 26 and 28 in a well known manner such as welding or the like. The plate 30 is pierced by a pierced rod 32 at the end of the reduction of the zirconium tetrachloride with magnesium a passageway for the magnesium chloride.

Designated by reference numeral 13 is a screw feeder comprising a sleeve 14 extending through the compartment rest 2 and a screw shaft 16 contained within the sleeve 14 for feeding solid zirconium tetrachloride into the reaction chamber 1. The sleeve 14 has its inner end opened to the inner face of the compartment 2 and its intermediate portion connected with a zirconium tetrachloride supplying pipe 15. Upwardly connected to the pipe 15 is a rotary feeder 23 for continuously feeding purified solid zirconium tetrachloride. Feeder 23 is connected to a reservoir 24 for storing the purified solid zirconium tetrachloride. The supplying rates of the solid zirconium tetrachloride is controlled through the screw feeder 13 in accordance with reaction rates, that is, the change in the internal pressure of the reaction chamber 1.

As illustrated in detail in FIG. 2, the screw shaft 16 is packed at the outer end of the sleeve 14 with a polytetraflourethylene gasket 17 for sealing the zirconiun tetrachloride gas and with a rubber O-ring 18 for sealing air. The screw shaft 16 is supported at its outer side by bearings 20 and provided at its outer end with a following sprocket 19. Further, the screw shaft 16 is provided with an axial bore 21, the inner end of which is closed and the outer end of which is opened for receiving a cooling water pipe 22 therein.

A water jacket means 41 is provided with valves 42 and 43 through which a cooling water is introduced during the reduction process for rapidly cooling the zirconium tetrachloride gas flowing from the reaction chamber 1 into the screw feeder 13.

FIG. 3 shows another means for supplying the zirconium tetrachloride in the solid state wherein a push rod 34 is reciprocated by a piston motor or an oil cylinder.

Referring back to FIG. 1, a vessel 3, to the inner surface of which the residual magnesium chloride and unreacted magnesium is to be adhered, has its lower end portion opened and provided with a flange 6 resting on the upper face of the compartment rest 2. The flange 6 is bolted to the flange 4 of the compartment rest 2 through packing means, such as for example, a metal packing or a silicone rubber packing. The vessel 3 has its upper end connected to a pipe 31 connected to a vacuum pump, not shown, for introducing an inert gas into the vessel 3 prior to the vacuum separation and for making the vessel 3 vacuous during the vacuum separation. The lower portion of the vessel 3 is contained within an electric heating furnace 10.

For the purpose of cooling the vessel 3, cooling water is showered upon the outer surface thereof from a distributing pipe 35 disposed on the upper portion thereof. The cooling water is received by a receiver 36 disposed on the lower portion of the vessel 3. A rubber packing 40 is applied to the receiver 36 for preventing leakage of the cooling water as is illustrated in FIG. 5.

FIG. 4 illustrates an arrangement which may be used to serve compartment rest 2 to the chamber 1 and the vessel 3. A flange of the reaction chamber 1 for example, is shown bolted to a flange of the compartment rest 2, wherein reference numeral 50 indicates a rubber packing, 51 is a cooling water groove, and 52 is a pipe for exhausting gas.

Operation

The practice of this invention with the apparatus of FIG. 1 is carried out in the following manner. The reaction chamber 1 is preheated for evacuation after making sure that the seal is effective. The reaction chamber 1 is then supplied with an inert gas through the pipe 28 so that the internal pressure thereof becomes in the range of 1.05 to 1.1 $Kg/cm^2$, that is, slightly higher than atomospheric pressure. The vessel 3 is also supplied with an inert gas through the pipe 31 in a like manner. The reaction chamber 1 is then heated at approximately 800° C by the electric heating furnace 8 and the compartment rest 2 is heated at approximately 650° to 800° C by the electric heating furnace 9. At this time, the internal pressure of the reaction chamber 1, which increases in comparison as the temperature rises, is adjusted by discharging the inert gas from the reaction chamber 1 through the pipe 28 so as to be held slightly higher than the atmospheric pressure.

After the above operations are completed, fused magnesium or sodium is introduced through the pipe 26 into the reaction chamber 1 and zirconium halide, such as for example, zirconium tetrachloride is introduced from the reservoir 24 into the reaction chamber 1 through the screw feeder 13. In this case, the magnesium may be previously placed in the reaction chamber 1. The reduction of the zirconium tetrachloride with the magnesium is carried out within the reaction chamber 1 as expressed by the following equation.

$$2Mg + ZrCl_4 = Zr + 2MgCl_2$$

to form metallic zirconium and magnesium chloride. During the reduction, a cooling gas is introduced through the pipes 12 into the space 11 for the purpose of cooling the reaction chamber 1 so as to suppress the formation heat. At the end of the reduction process, the magnesium chloride is discharged through the pipe 26 from the reaction chamber 1 with the inert gas adjusting the internal pressure thereof. The pipe 26, the end portion of which hangs within the reaction chamber 1, serves to effectively discharge the fused magnesium chloride accumulated on the produced zirconium sponge without the fused magnesium chloride sinking into the zirconium sponge. After the magnesium chloride is discharged, the reaction chamber 1 is supplied with additional fused magnesium through the pipe 26 and the above process is repeated until the produced zirconium sponge reaches the end of the pipe 26 for the purpose of producing metallic zirconium as much as possible within the reaction chamber 1. The supplying rate of the powder zirconium tetrachloride is controlled through the screw feeder 13 in accordance with reaction rates, that is, the change in the internal pressure of the reaction chamber 1. During the reduction, a cooling water is introduced into the water jacket 41 through the valves 42 and 43 and into the water pipe 22 inserted into the axial bore 21 of the screw shaft 16 to cool the screw feeder 13 so as to rapidly cool the zirconium tetrachloride gas flowing into the screw feeder 13 to convert it to the powder form thereby preventing the zirconium tetrachloride from adhering to the screw feeder 13 to block it. After the reduction, the cooling water is discharged from the water jacket 41 and a heater is inserted in the bore 21 of the screw shaft 16 instead of the water pipe 22 to prevent the magnesium chloride and magnesium from adhering to the compartment rest 2.

At the end of the reduction of the zirconium tetrachloride over the magnesium to produce the zirconium sponge, the piercing rod 32 is operated to break the plate 30 and the pump means is actuated to make the vessel 3 vacuous through the pipe 31 so as to vaporize and adhere the residual magnesium chloride and unreacted magnesium to the inner surface of the vessel 3. During this vacuum separation, cooling water is showered from the distributing pipe 35 upon the outer surface of the vessel 3 so as to effectively adhere the vaporized magnesium chloride and unreacted magnesium onto the vessel 3. Also, during the vacuum separation, the compartment rest 2 is heated at approximately 650° to 800° C as described above, so as to prevent the vaporized magnesium chloride and unreacted magnesium from adhering to the compartment rest 2. During the vacuum separation the reaction chamber is also heated at a temperature above 900° C and the space 11 is made vacuous through the pipes 12 to prevent the reaction chamber 1 from deforming.

At the end of the vacuum separation, the reaction chamber 1 and the vessel 3 are again supplied with the inert gas prior to recovery of the metallic zirconium within the reaction chamber 1. The recovery of the produced zirconium sponge is carried out by separating the reaction chamber from the vessel 3 and compartment rest 2 and piercing the bottom plate 33.

After one cycle of the process is completed, a new plate 33 is welded to the bore of the vessel 3 at which the pipe is connected to the vessel 3 and the position of the vessel 3 and the reaction chamber 1 is upended so that the vessel 3 will become the reaction chamber with the magnesium chloride and magnesium adhering thereto in the next cycle of the process. It should be noted that the welding of the plate 33 can be carried out in the inert gas atmosphere to prevent the magnesium chloride from absorbing moisture and magnesium from catching fire.

According to the process of this invention wherein solid zirconium halide is directly contacted with and reduced over alkaline earth metal or alkali metal by a predetermined amount, the supply of the zirconium halide can be simply accomplished in accordance with the change in the internal pressure of the reaction chamber without any special training or skill and does not require the zirconium halide to be placed previously within the reaction chamber. Therefore, the reaction chamber may be relatively reduced in size and several reactions are possible by a batch within the reaction chamber to produce the zirconium in greater quantities than is conventionally the case. Additionally, the process is carried out with high thermal efficiency since the reaction heat of the zirconium tetrachloride can be applied to sublimate heat it and is easy to promote thermal condition thereby permitting the reaction to take place at a high rate. Further, since the process can prevent the reaction chamber from being eroded at an elevated temperature, the quality of the produced zirconium sponge is kept high. Also, since only extremely little amount of the zirconium tetrachloride gas is mixed with the inert gas, material loss can be minimized and blockage of valves or the like does not occur.

According to the apparatus of this invention, since the reduction of the zirconium halide and the following vacuum separation can be continuously carried out in a single unit, required operation times and heat energy are considerably reduced in comparison with the conventional case, and the recovery rate of zirconium is improved in amount from 90 to 96%.

EXAMPLE

The reservoir 24 was supplied with 110 Kgs of powder $ZrCl_4$ refined by another means and disposed on the assembled rotary feeder 25 and screw feeder 13. The reaction chamber 1 had previously been supplied with 12 Kgs (40% more than the theoretical value) of Mg and bolted through rubber packings to the compartment rest 2, having the plate 30 welded thereto, and to the vessel 3. After testing the seal and evacuating the reaction chamber, argon gas was introduced through the pipe 24 into the reaction chamber 1 up to a gage pressure of 0.2 Kg/cm$^2$. The argon gas flowed through the spaces of the screw feeder and rotary feeder into the reservoir 24. During the evacuation, the reaction chamber 1 was heated by the electric heating furnace 8 at 200° to 300° C and the temperature was raised to 750° C after the argon gas was introduced thereto. When the internal pressure, which increases in comparison as the temperature rises, reached 0.5 Kg/cm$^2$, the argon gas was discharged until the internal pressure decreased to 0.2 Kg/cm$^2$. When the temperature of the reaction chamber 1 rose to 750° C, the internal pressure thereof was further decreased to 0.1 Kg/cm$^2$ and the screw feeder and rotary feeder were actuated to supply the $ZrCl_4$ into the reaction chamber 1. The $ZrCl_4$ was reduced at the surface of the fused magnesium as expressed by the following equation:

$$ZrCl_4 + 2Mg = Zr + 2MgCl_2$$

A part of the $ZrCl_4$ vaporized at the elevated temperature of the reaction chamber 1 and therefore, the inner pressure slightly increases. At the time by stopping the supply of the $ZrCl_4$, the $ZrCl_4$ gas was reduced and the internal pressure decreased to 0.1 Kg/cm$^2$. $ZrCl_4$ was again supplied into the reaction chamber until the internal pressure increased to 0.4 Kg/cm$^2$. The supply of $ZrCl_4$ was stopped and the internal pressure began to decrease. When the internal pressure decreased to 0.1 Kg/cm$^2$ the $ZrCl_4$ was again supplied into the reaction chamber 1. The above operation was repeated. Such on and off operation of the $ZrCl_4$ was carried out automatically in accordance with the change in the internal pressure gage with the supply means. The first cycle of the reduction took 1.5 hours of supplying time and the average $ZrCl_4$ feed rate was 28 Kg/hr. During the time that $ZrCl_4$ was being fed into the reaction chamber, the screw feeder was cooled by cooling water introduced into the water jacket and into the pipe inserted in the axial bore of the screw shaft. When the magnesium was consumed, the internal pressure of the reaction chamber did not decrease, and thereby the end of the reduction was judged. After the reduction was completed, 22 Kgs of $MgCl_2$ was taken out by the argon gas into the reaction chamber 1.

Then, 5 Kgs of fused Mg was introduced through the pipe 26 into the reaction chamber 1 and the internal pressure was again decreased to 0.1 Kg/cm$^2$, and then the $ZrCl_4$ was again supplied into the reaction chamber 1 according to the same starting and stopping procedure described above. The second cycle of the reduction took 35 minutes and the average supplying rate was 27 Kg/hr. In this case, 14 Kgs of $MgCl_2$ was taken out. Five reduction operations were carried out taking 3.7 hours, and 78Kgs of $MgCl_2$ taken out.

After the above operations were completed, the plate 30 was broken by the piercing rod 32 and the temperature was increased to between 960° and 980° C to evacuate the chamber for vacuum separation.

The $MgCl_2$ and Mg within the reaction chamber 1 adhered to the inner surface of the vessel 3 as a result of the vacuum separation step. The outer surface of the vessel 3 was cooled by showered cooling water. During vacuum separation, the vessel 3 was made vacuous in the order of $10^{-3}$ to $10^{-4}$ mmHg and the space 11 was also made vacuous to prevent deformation of the reaction chamber 1. The vacuum separation took 16 hours and 38 Kgs of Zr subsequently taken out.

The test results are represented in the following table.

| | | | REACTION STATE | | | |
|---|---|---|---|---|---|---|
| Run Number | Amount of $ZrCl_4$ Used | Amount of Mg Used | Zr Recovered | $MgCL_2$ Recovered | the Reaction Time | Supplying rate of $ZrCL_4$ |
| 1 | 42.2Kg | 12Kg | 16Kg | 22Kg | 90 minutes | 28Kg/hr |
| 2 | 15.8Kg | 5Kg | 6Kg | 14Kg | 35 minutes | 27Kg/hr |
| 3 | 15.8Kg | 5Kg | 6Kg | 14Kg | 35 minutes | 27Kg/hr |
| 4 | 13.2Kg | 4Kg | 5Kg | 14Kg | 30 minutes | 26.4Kg/hr |
| 5 | 13.2Kg | 4Kg | 5Kg | 14Kg | 30 minutes | 26.4Kg/hr |
| Total Amount | 100.2Kg | 30Kg | 38Kg | 78Kg | 220 minutes | 27.0Kg/hr |

What is claimed is:

1. An apparatus for producing zirconium sponge comprising:

a reaction chamber having an outwardly turned flange at one end thereof and being closed at the opposite end by a bottom plate, said chamber being joined to a vessel also equipped with an outwardlyly turned flange at one end, a port at the other end for introducing inert gas into said vessel, and a piercing rod extending through said port parallel to the major axis of said vessel;

said chamber being joined to said vessel via a cylindrical seat means comprising outwardly turned flanges compatible with and secured to the outwardly extending flange of said vessel and said reaction chamber, respectively, an inner face projecting slightly inward of said reaction chamber having circumferentially attached thereto a circular plate sealing the inside of said reaction chamber from the inside of said vessel, and first and second pipes extending through the portion of said seat means in communication with said reaction chamber, said first pipe introducing inert gas to said reaction chamber and said second pipe having extending downwardly into said reaction chamber for introducing manganese to said chamber and discharging manganese halide from said chamber;

said apparatus further comprising a screw feeder in communication with a reservoir supplied with powdered zirconium halide, said screw feeder comprising a screw shaft mounted within a sleeve having a port therein for receiving solid zirconium halide gravitationally fed to said screw feeder from said reservoir and extending through a portion of said cylindrical seat means in communication with said reaction chamber such that upon rotation of said screw shaft solid zirconium halide is fed from said reservoir to said chamber; and a plurality of furnaces surrounding said reaction chamber, said cylindrical seat means and a portion of said vessel, said furnace surrounding said reaction chamber defining a space between said chamber and said furnace wherein a cooling gas may be introduced for cooling said chamber.

2. Apparatus adapted for use in a process of reducing zirconium halide comprising, (a) a reaction chamber, (b) a heater positioned for heating said reaction chamber, (c) a vessel positioned in sealing and secured relation to said reaction cahmber, (d) means sealing the inside of said reaction cahmber from said vessel comprising a cylindical seat means, one open end of said seat means being secured to said vessel at an open end thereof, the second open end of said seat means being secured to said chamber at an open end thereof, and a sealing plate being secured to the inner face of said seat means near one open end thereof to seal said open ends from one another and the inner face of said seat means projecting slightly inward from the inner surface of said reaction chamber, (e) means for charging and discharging inert gas into and out of said chamber to control the pressure therein, (f) means for supplying a reducing agent to said chamber and for venting a salt of said reducing agent formed during said reducing process, said means for supplying comprising a hollow pipe passing into said chamber and being bent downward toward the bottom of said chamber, (g) means for automatically adding zirconium halides to said chamber at a controlled feed rate comprising a pipe connecting a source of solid zirconium halide to said reaction chamber and a surface for forcing solid zirconium halide through said pipe to said reaction chamber, and (h) piercing means within said vessel for piercing said sealing means.

3. The apparatus of claim 2 wherein said means for charging and discharging comprises a second hollow pipe passing through the wall of said seat means, and where said first pipe passes through the wall of said seat means, both of said pipes opening into the space of said seat and said chamber below said sealing plate.

4. The apparatus of claim 3 wherein said means for automatically adding comprises a screw feeder mechanism having one end opening through said seat wall into the space below said sealing plate.

5. The apparatus of claim 2 wherein said heater surrounds said reaction chamber and defines a space between said chamber and said heater where a cooling agent may be introduced to cool said chamber and further comprising, a cooling means for cooling said screw feeder, and means for cooling the walls of said vessel.

* * * * *